US006671159B2

(12) United States Patent
Nakamura et al.

(10) Patent No.: US 6,671,159 B2
(45) Date of Patent: Dec. 30, 2003

(54) POWER SOURCE BREAKER

(75) Inventors: Goro Nakamura, Shizuoka-ken (JP); Takahiro Sato, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 331 days.

(21) Appl. No.: 09/779,731

(22) Filed: Feb. 9, 2001

(65) Prior Publication Data

US 2001/0015883 A1 Aug. 23, 2001

(30) Foreign Application Priority Data

Feb. 15, 2000 (JP) ..... P 2000-036991

(51) Int. Cl.[7] ..... H01H 47/00
(52) U.S. Cl. ..... 361/170; 361/160; 361/58
(58) Field of Search ..... 361/103, 90, 58, 361/93.1, 170, 160

(56) References Cited

U.S. PATENT DOCUMENTS 5,535,842 A 7/1996 Richter et al. ..... 180/279
6,462,293 B2 * 10/2002 Nakamura et al. ..... 200/318.1

FOREIGN PATENT DOCUMENTS

JP 11-204015 7/1999 ..... H01H/73/36

* cited by examiner

*Primary Examiner*—Stephen W. Jackson
(74) *Attorney, Agent, or Firm*—Finnegan, Henderson, Farabow, Garrett & Dunner, L.L.P.

(57) ABSTRACT

A compact gas-expansion-type power source breaker by which a power supply circuit can be forcedly and surely isolated only in case of abnormalities such as short-circuiting of a wire harness or collision of road vehicles is provided. A lock 18 for constraining movement of a shaft 16 is set in a locked state by means of pushing force for constraining the movement of the shaft 16 forcedly provided by a reset spring 19 on one hand, and is connected via a lock operation plate 20 with a piston 21 for forcedly providing a reverse pushing force beyond the pushing force of the reset spring 19 sublimation of a gaseous actuating reagent 23 contained in a igniter 22 on the other hand. Once a circuit-cut signal is applied to the igniter 22, the gas actuating reagent 23 will vaporize or sublimate, and the piston 21 will operate to make the lock 18 released forcedly from the shaft 16, only when the piston 21 is provided with the reverse pushing force beyond the pushing force of the reset spring 19 by means of gases generated by the vaporization or sublimation of the gaseous actuating reagent 23. Consequently, it can be avoided that the shaft may move slidingly due to any other causes such as impulse, vibration than the vaporization or sublimation of the gaseous actuating reagent 23, resulting in the isolation of the power supply circuit.

6 Claims, 6 Drawing Sheets

POWER SOURCE BREAKER

BACKGROUND OF THE INVENTION

The present invention relates to an electric power source breaker which isolates a power supply circuit by means of sublimation of a gaseous actuating reagent, and relates in particular to a compact power source breaker which can forcedly and surely isolate a power supply circuit in case of something unusual such as short circuiting of a wire harness, collision of road vehicles.

FIG. 1 is a systematic diagram showing an example for electronic automobile parts to which a conventional power source breaker is applied. As shown in the figure, the electronic automotive part 100 includes a power supply circuit assembled by connecting a battery 101 of an automobile to each load 102–104 disposed at each location of the automobile using a wire harness 106 with electric wires 105, and a power source breaker 107 intervened in the power supply circuit.

When a circuit-cut signal generated at a power source controller 108 is input in case of something unusual such as short circuiting of a wire harness 106, collision of road vehicles, the power source breaker 107 can stop supplying power from the battery 101 to each load 102–104 etc. through releasing a lock in a manner as described hereinafter according to FIG. 2.

FIG. 2 is a configuration of a solenoid-type power source breaker 107A showing an example of the power source breaker 107 in FIG. 1, and FIG. 2A is a top view and FIG. 2B is a side view. The solenoid-type power source breaker 107A includes a shaft 111, disposed on a base body 110 as shown in FIG. 2A, which is constrained with a lock 113 pressing down the shaft 111 to maintain a terminal 112*a* and a terminal 112*b* electrically continued in a connected state, before the circuit-cut signal is input to the solenoid-type power source breaker 107A at the initial state.

At this initial state, electric current in the power supply circuit flows through the rout of the terminal 112*a* the shaft 111 the terminal 112*b*, and the terminal 112*a* and the terminal 112*b* can supply a large current because of their having the multicontact spring structures.

When the circuit-cut signal is input, by supplying current to a solenoid 115 for drawing a plunger 116 in order to release the lock 113 in a linked state with the shaft 111, pushing forward the shaft 111 by means of pushing force provided by a release spring 114 to make the terminal 112*a* isolated from the terminal 112*b*, finally making the terminal 112*a* electrically open off from the terminal 112*b* to stop supplying power from the battery 101 to each load 102–104 etc.

However, in the conventional structure shown in FIG. 2, once an impulse is applied to the shaft 111 in the axial direction shown as an arrow A in the figure, the plunger 116 of the solenoid 115 is liable to malfunction to draw a lever 118, and the malfunction may result in a problem of releasing the lock 113 out of a linked state with the shaft 111. There has been also a problem that a need of miniaturization cannot have been coped with due to the use of the solenoid 115.

SUMMARY OF THE INVENTION

The present invention, in consideration of the situation described above, aims to provide a power source breaker which can forcedly and surely isolate a power supply circuit in case of abnormalities such as short circuiting of a wire harness, collision of road vehicles, and also has a structure suitable for miniaturizing itself.

In order to achieve the above object, in the present invention at the initial position where a pair of terminals intervened in a power supply circuit is set in a connected state, and a shaft 16 forcedly provided by a release spring 17 with pushing force for sliding movement of itself is linked with a lock 18 forcedly provided by a reset spring 19 with pushing force for constraining sliding movement of the shaft, and a pushing force of a linear actuator 25 is converted into a force in the direction for liberating the linkage with the lock against the reset spring by means of a lock operation plate 20 as a lock liberating means.

According to the present invention, only when the pushing force of the linear actuator 25 goes beyond the pushing force of the reset spring 19, the lock liberating means is actuated, and it can be avoided that the lock may be liberated resulting in the sliding movement of the shaft.

In another embodiment of the present invention, a linear motor has an actuating reagent and an internal gas pressure is changed by vaporization or sublimation of the actuating reagent when the linear motor operates. Because of no adoption of any solenoid, the power source breaker can further be miniaturized, and that will be preferable in order to cut down manufacturing cost.

Further, according to the present invention, since the shaft can be reset immediately after an operation of the shaft, it is easy to make the power supply circuit reset again at an electrically closed state.

BRIEF DESCRIPTION OF THE DRAWINGS

FIG. 2 is a diagram showing an example of a conventional power source breaker.

DESCRIPTION OF THE PREFERRED EMBODIMENT

Figure 1:
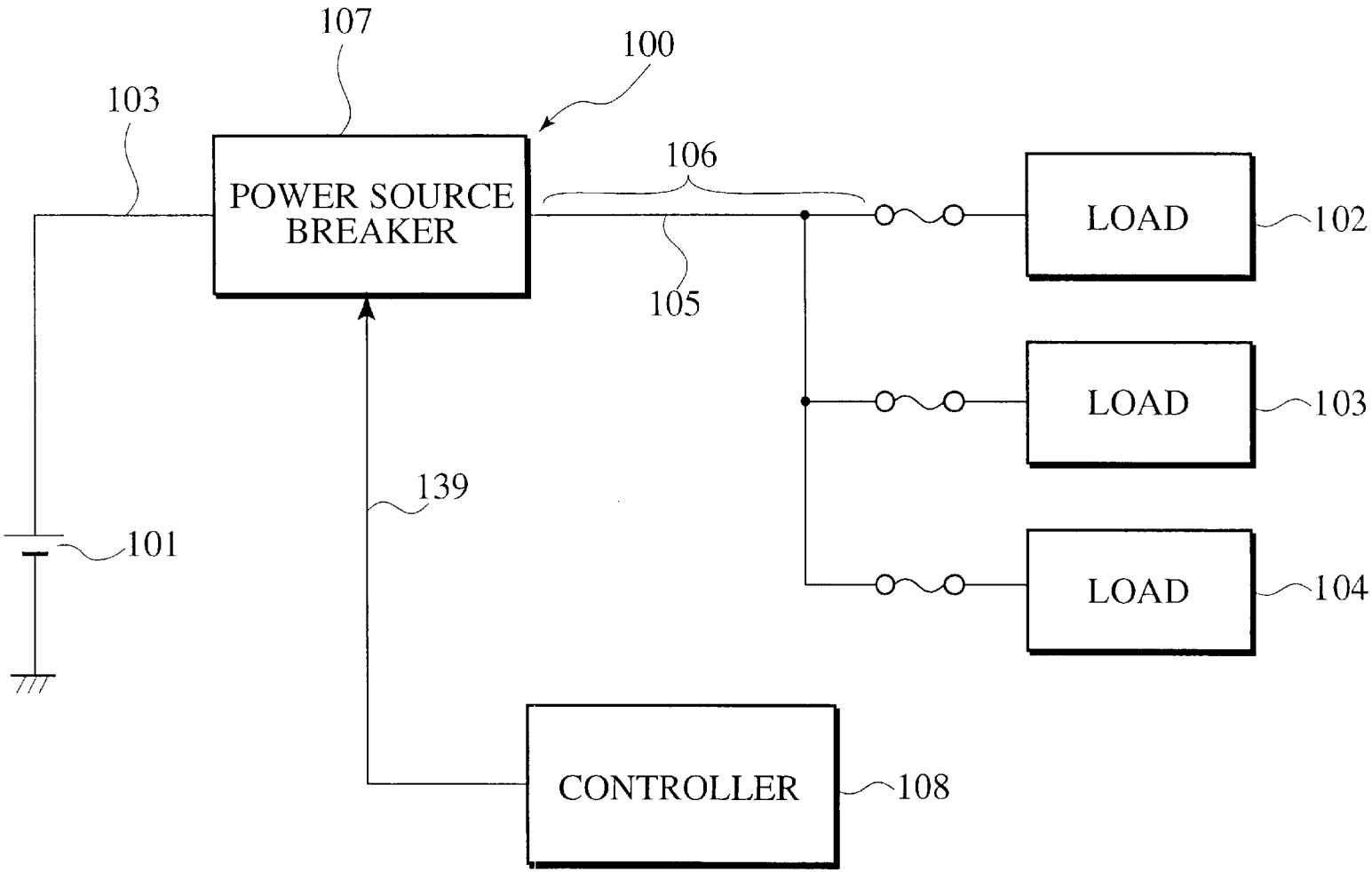
FIG. 1 is a systematic diagram showing an example of an electronic automobile parts system to which a conventional power source breaker is applied.
Figure 2A:
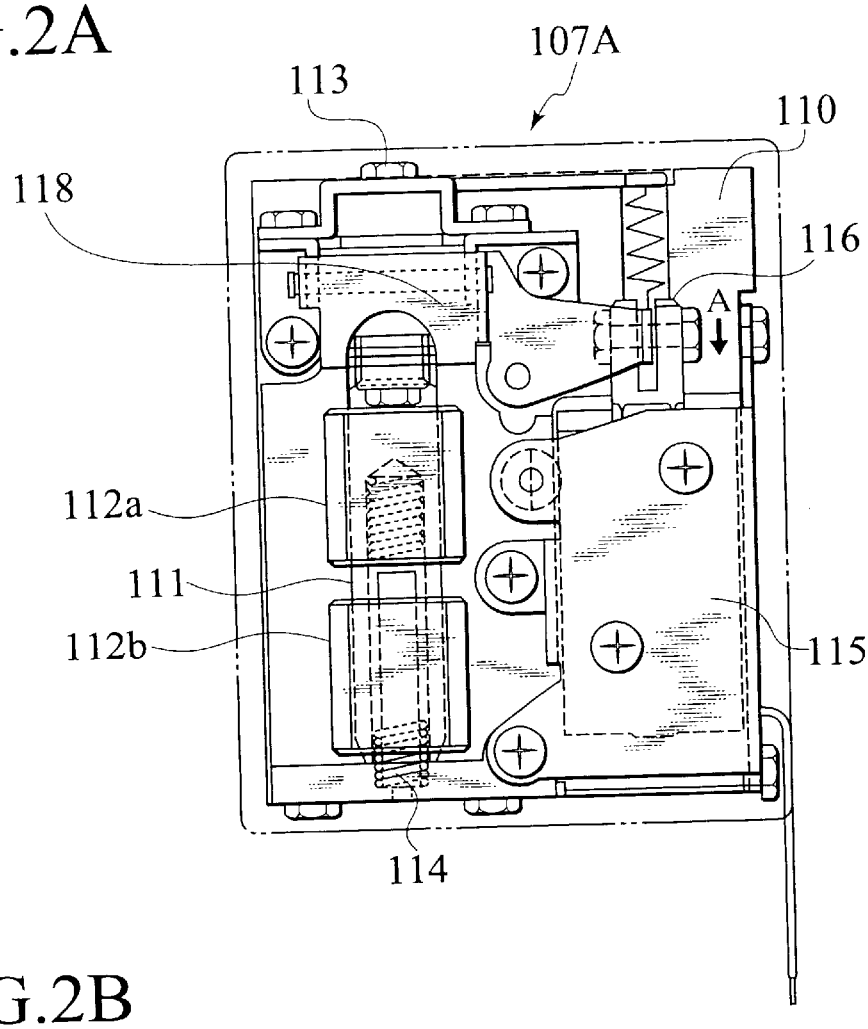
FIG. 2A is the top view and FIG. 2B is the side view.
Figure 2B:
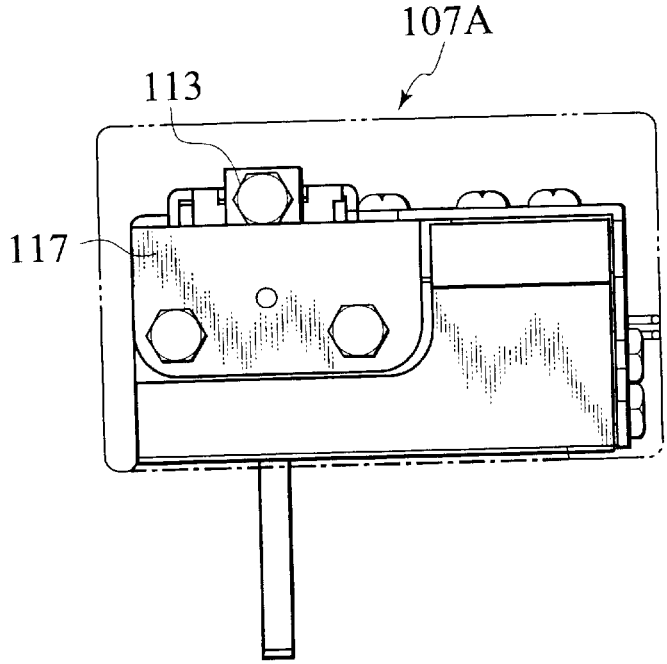
Figure 3:
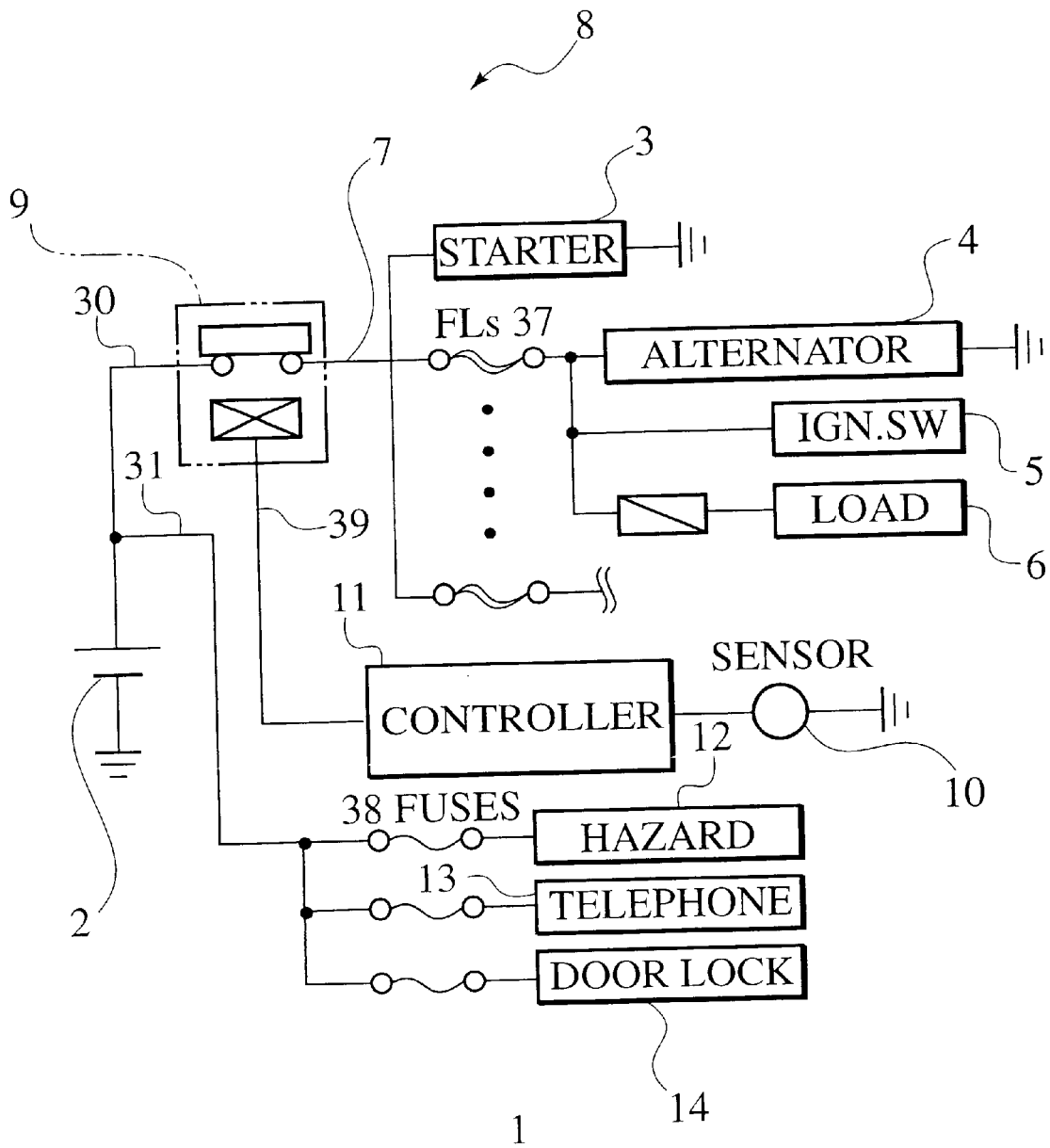
FIG. 3 is a systematic diagram showing an embodiment of an electronic parts system to which a power source breaker according to the present invention is applied.

FIG. 3 is a systematic diagram showing an embodiment of an electronic automobile parts system to which a power source breaker according to the present invention is applied.

As shown in the figure, the electronic automobile parts system 1 includes a power supply circuit formed by connecting, with a wire harness 8 represented as a circuit 7, each load such as a battery 2 of a road vehicle, a starter 3, an alternator 4, an ignition switch (IGN.SW) 5, other loads 6, and the power source breaker 9 according to the present invention intervened between a circuit 30 connected to the battery and the circuit 7. Further, both an abnormality detecting sensor 10 such as a acceleration sensor and a power source controller 11 for isolating the power source according to the detected abnormality like an impulse etc. are used to operate the power source breaker 9. The abnormality detecting sensor detects abnormalities like a collision and a fall as a sudden change of acceleration or occurrence of an impulse, an impulsive sound, an electromagnetic wave, etc., and transmits the occurrence of the abnormalities to the power source controller by means of an electric signal or an optical signal, and moreover a plurality of detecting means or judging means may be used in conjunction with each other.

The output 39 of the controller may be utilized to operate a safety equipment like a air bag, an alarm system, or a report system. A hazard 12, a telephone (PHONE) 13, and a door lock (D/L) 14, are some examples of the system members which need not to be isolated from the power supply circuit by the power source breaker 9, and are supplied with power from the battery through a circuit 31.

Figure 4:
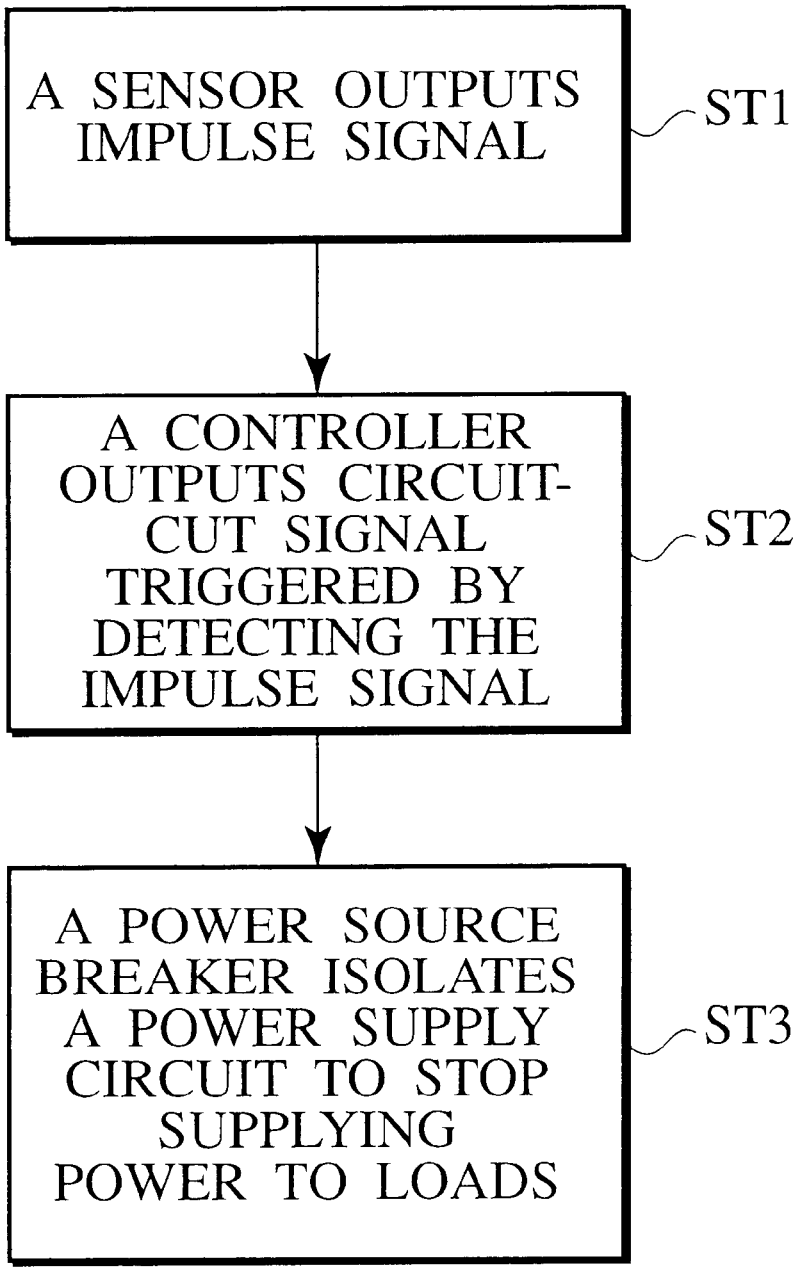
FIG. 4 is a flowchart showing an isolation flow of the electronic automobile parts system in FIG. 3.

As shown in the isolation flow of FIG. 4, when a road vehicle collides with a body like a preceding vehicle for example, the sensor 10 outputs an impulse signal to the power source controller 11 (step ST1), and then a circuit-cut signal is generated at the power source controller 11 and the circuit-cut signal generated is output to the power source breaker 9 (step ST2).

Consequently, the power source breaker 9 can isolate the power supply circuit and stop supplying power from the battery 2 to each load such as the starter 3, the alternator 4, the ignition switch (IGN.SW) 5 as will be described below on the basis of FIG. 3–FIG. 6 (step ST3).

Figure 5:
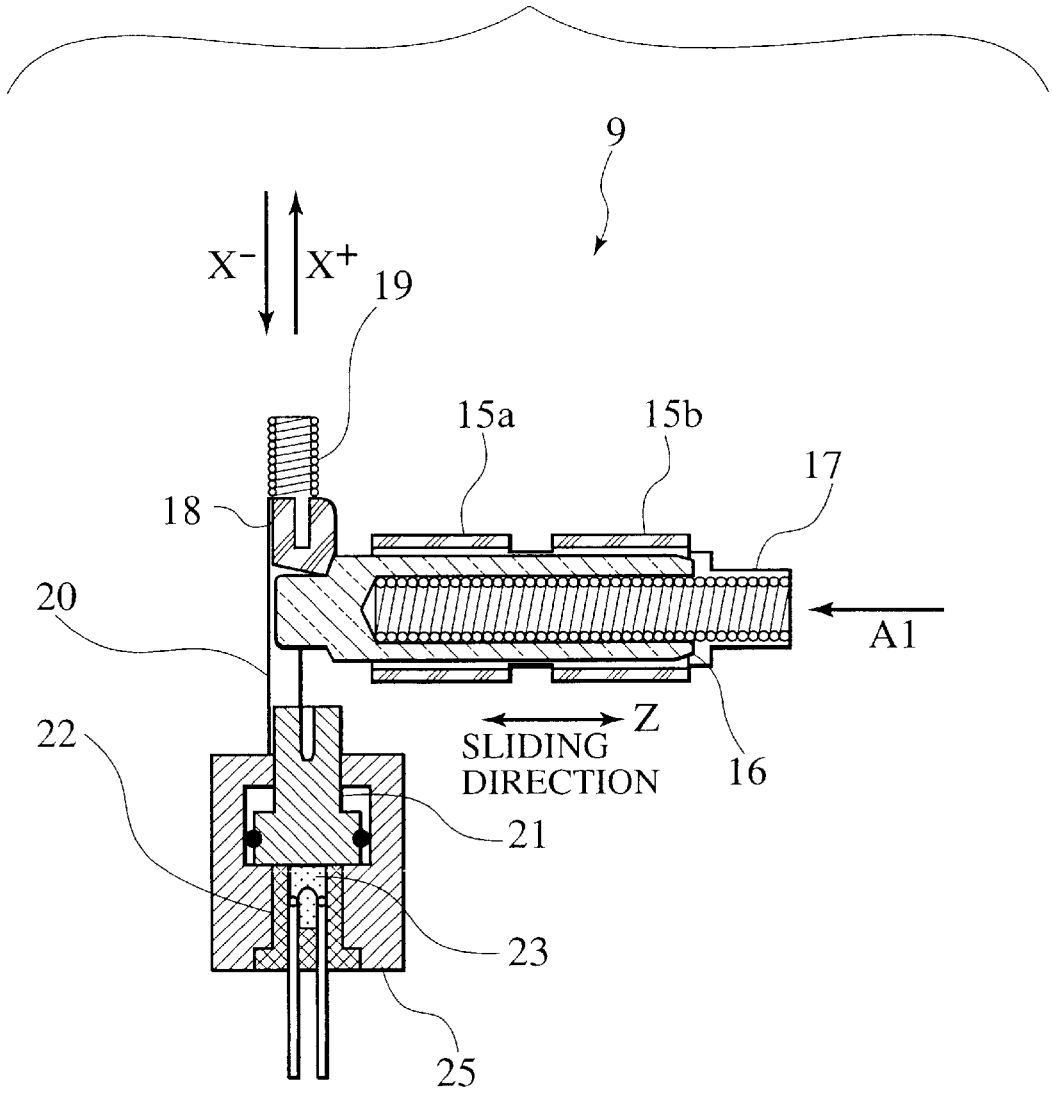
FIG. 5 is a side sectional view of a main portion showing the structure of an embodiment of a power source breaker according to the present invention.
Figure 6A:
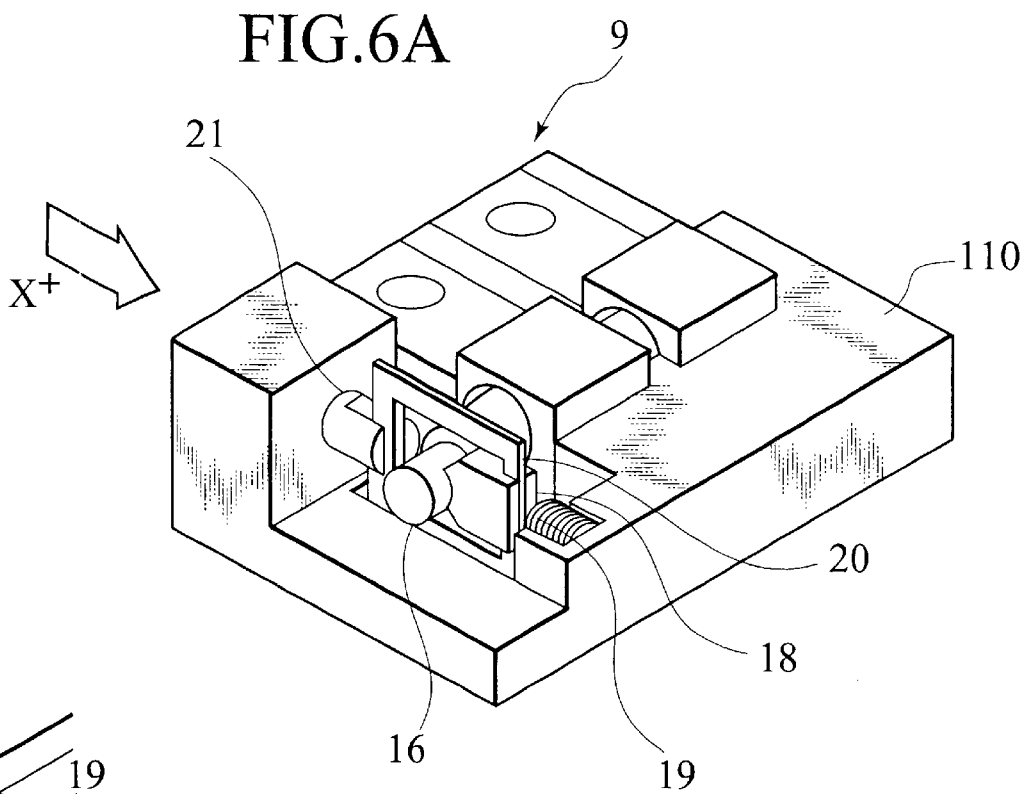
FIG. 6 is a perspective view showing the structure of the embodiment of the power source breaker shown in FIG. 5.
Figure 6B:
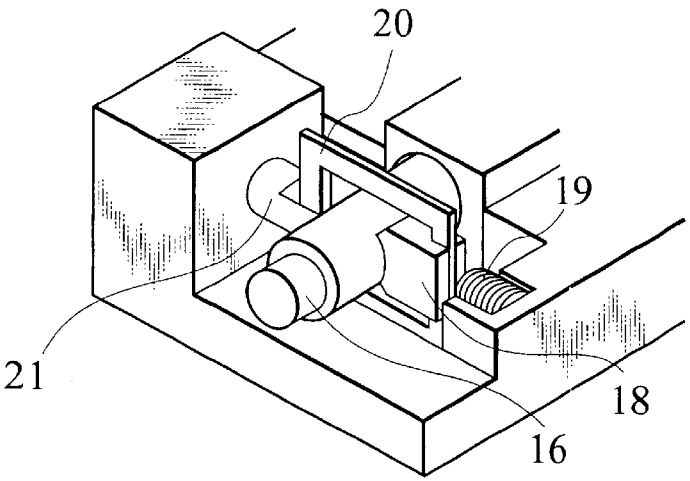

FIG. 5 is a side sectional view of a main portion showing the structure of an embodiment of a power source breaker 9 relating to the present invention. FIG. 6 is a diagram of the power source breaker 9, and FIG. 6A of the figure is a perspective view showing the initial state before liberation of a lock, and FIG. 6B of the figure is a perspective view of a main portion showing a state after liberation of the lock.

The gas-expansion-type power source breaker 9 has a pair of terminals 15*a*, 15*b* intervened in a power supply circuit connecting a battery of a road vehicle to each load disposed at each portion of the road vehicle. Further, an electrically conductive shaft 16 is disposed on a base body, and at the initial state (the state shown in FIG. 5) before the operation of the shaft 16 to which pushing force is forcedly provided by a release spring 17 in order to make the shaft move sliding along the arrangement direction (Z) of each terminal 15*a*, 15*b*, and an end portion of the shaft 16 is linked with a lock 18 to constrain the sliding movement of the shaft 16. At this state, each of the terminals 15*a*, 15*b* is set in an electrically connected state.

Due to the situation, an electric current of the power supply circuit flows through the terminal 15*a*, the shaft 16, and the terminal 15*b*, and further a large electric current can flow through the terminals 15*a*, 15*b* owing to their multi-contact spring structure.

The lock 18 for constraining movement of the shaft 16 is disposed movably in a direction at a prescribed angle to the sliding direction Z, and is forcedly provided by a spring 19 with pushing force for constraining movement of the shaft 16 to establish in a locked state. Consequently, once the lock 18 is liberated from the linked state with the shaft 16, the shaft 16 is pushed forwards (A1 direction shown by the arrow) by means of pushing force forcedly provided by the release spring 17, and each of the terminals 15*a*, 15*b* is set in an isolated state with each other resulting in isolation of a circuit 30 from a circuit 7.

A piston 21 of a linear actuator 25 is connected to the lock 18 via a lock operation plate 20, and a reverse pushing($X^+$ direction) force beyond the pushing($X^-$ direction) force of the reset spring 19 is forcedly provided to the piston 21 by means of vaporization or sublimation of a gaseous actuating reagent 23 contained in an igniter 22. Namely, once a circuit-cut signal is applied to the igniter 22, the gaseous actuating reagent promptly vaporizes or sublimates, and the piston 21 generates a prescribed pushing force through a sudden increase of an internal pressure of the actuator accompanied by the generation of gases generated by vaporization or sublimation of the gaseous actuating reagent 23. The pushing force is converted into the force which acts in such a direction as to liberate the lock 18 with the lock operation plate and is then transmitted to the lock. Consequently, the lock operates owing to the pushing force of the piston 21 beyond the pushing force of the spring 19, and the lock 18 is forcedly released from the shaft 16. The lock operation plate 20 is mechanically connected to both the linear actuator and the lock, and such a structure can be adopted as to convert the pushing force of the linear actuator into the force which acts in order to liberate the linked state of the lock with the shaft.

Since the lock 18 can reset the shaft 16 through returning the shaft to the initial linked state by means of the pushing force provided by the reset spring 19, it can be easily done that the shaft 16 is reset at the initial position promptly after the operation of the shaft 16 and the power supply circuit is again set in the electrically closed state.

Thus, the power source breaker 9 according to the present invention has such a structure that it operates only when the pushing force of the piston 21 goes beyond the pushing force of the spring 19, and the lock 18 is forcedly released from the shaft 16, and that the lock 18 is connected in one body with the linear actuator 25 via the lock operation plate 20, and therefore the power supply circuit can be isolated forcedly and surely only in case of abnormalities such as short-circuiting of a wire harness, collision of road vehicles. Since no solenoid is adopted as the lock liberating means, a requirement for further miniaturization of power source breakers of this kind can be coped with, and that is much preferable for cutting down a manufacturing cost.

Although the structure wherein the pushing force is generated by a pressure increase due to vaporization or sublimation of the gaseous actuating reagent is adopted for the linear actuator in the present embodiment, any other structure, wherein at least a linear driving force can be generated by pushing force for a prescribed duration, can be adopted, and for example, the piston can be actuated by means of a compressed gas supplied through controlling with an electromagnetic valve. Besides, a rotary motion may be converted into a linear motion by means of a mechanical converter such as a gear system, a lever. In this case, the mechanical converter has a function to convert rotating torque into linear force.

According to the present invention, at the initial position where a pair of terminals intervened in a power supply circuit is set in a connected state, and a shaft forcedly provided by a release spring with a pushing force for sliding movement of itself is linked with a lock forcedly provided by a reset spring with a pushing force for constraining a sliding movement of the shaft, and a pushing force of a linear actuator is converted into a force in the direction for liberating the linkage with the lock against the reset spring as a lock liberating means. Consequently, only when the pushing force of the linear actuator goes beyond the pushing force of the reset spring, the lock liberating means may be actuated, and it can be avoided that the lock may be liberated resulting in sliding movement of the shaft.

Since no solenoid is adopted as the lock liberating means, a requirement for further miniaturization of power source breakers of this kind can be coped with, and that is much preferable for cutting down a manufacturing cost.

What is claimed is:

1. A power source breaker, said power source breaker having a pair of terminals intervened in a power supply circuit connecting a battery of a road vehicle to loads, and a shaft contacting with and disconnecting from these terminals in sliding movement, said shaft moving from the initial position where each of said terminals is set in a connected state with each other to the isolated position where each of said terminals is set in a released state with each other, resulting in isolation of said power supply circuit, comprising:

a release spring which forcedly provides said shaft with pushing force for moving said shaft sliding along the arrangement direction of each of said terminals;

a lock linked with said shaft;

a reset spring which forcedly provides said lock with pushing force for constraining the sliding movement of said shaft;

a linear actuator which operates to generate larger pushing force beyond the pushing force of said reset spring; and A lock liberating means for liberating said shaft from the constrained state of the sliding movement; wherein said lock liberating means is connected with said linear actuator and said lock, and during the operation of said linear actuator the lock is forcedly provided with the pushing force of said linear actuator in the opposite direction of the pushing force of said reset spring.

2. A power source breaker, said power source breaker having a pair of terminals intervened in a power supply circuit connecting a battery of a road vehicle to loads, and a shaft contacting with and disconnecting from these terminals in sliding movement, said shaft moving from the initial position where each of said terminals is set in a connected state with each other to the isolated position where each of said terminals is set in a released state with each other, resulting in isolation of said power supply circuit, comprising:

a release spring which forcedly provides said shaft with pushing force for moving said shaft sliding along the arrangement direction of each of said terminals;

a lock linked with said shaft;

a reset spring which forcedly provides said lock with pushing force for constraining the sliding movement of said shaft;

a linear actuator which actuates a piston according to a change of its internal pressure and operates to generate larger pushing force beyond the pushing force of said reset spring; and A lock liberating means for liberating said shaft from the constrained state of the sliding movement; wherein said lock liberating means is connected with the piston of said linear actuator and said lock, and during the operation of said linear actuator the lock is forcedly provided with the pushing force of said linear actuator in the opposite direction of the pushing force of said reset spring.

3. A power source breaker of claim 2, wherein said linear actuator is provided with an actuating reagent, and vaporization or sublimation of the actuating reagent changes the internal pressure at the time of operation.

4. A power source breaker of claim 3, wherein said linear actuator is supplied with a compressed gas and is changed in its internal pressure at the time of operation.

5. A power source breaker of claim 1, wherein said linear actuator is provided with a motor and a mechanical converter, and said mechanical converter generates pushing force through converting rotation torque of said motor into linear motion.

6. A power source breaker of anyone of claims 1 to 5, wherein said lock resets said shaft at the initial position through returning the shaft to the initial linked position by means of the pushing force forcedly provided by said reset spring.

* * * * *

UNITED STATES PATENT AND TRADEMARK OFFICE

CERTIFICATE OF CORRECTION

PATENT NO. : 6,671,159 B2
DATED : December 30, 2003
INVENTOR(S) : Goro Nakamura et al.

It is certified that error appears in the above-identified patent and that said Letters Patent is hereby corrected as shown below:

Column 6,
Line 35, “anyone” should read -- any --.

Signed and Sealed this

Fifteenth Day of June, 2004

JON W. DUDAS
*Acting Director of the United States Patent and Trademark Office*